United States Patent [19]

Stewart, Jr.

[11] 3,969,779

[45] July 20, 1976

[54] DYEING AND PRINTING OF MATERIALS

[75] Inventor: William H. Stewart, Jr., Spartanburg, S.C.

[73] Assignee: Deering Milliken Research Corporation, Spartanburg, S.C.

[22] Filed: July 30, 1974

[21] Appl. No.: 493,187

[52] U.S. Cl. ..... 8/149; 8/151; 8/158; 68/205 R; 118/7

[51] Int. Cl.[2] ..... D06B 1/02

[58] Field of Search ..... 8/149, 151, 158; 68/205 R, 203; 118/8, 7, 2

[56] References Cited

UNITED STATES PATENTS

| | | | |
|---|---|---|---|
| 3,393,411 | 7/1968 | McElveen | 8/151 |
| 3,444,839 | 5/1969 | Ellul | 118/2 |
| 3,570,275 | 3/1971 | Weber et al. | 68/205 R |
| 3,682,131 | 8/1972 | Algeri | 118/2 |
| 3,741,139 | 6/1973 | Frentress | 112/79 |
| 3,768,439 | 10/1973 | Schweitzer | 118/2 |
| 3,785,179 | 1/1974 | Davis et al. | 68/5 |
| 3,832,213 | 8/1974 | Brenner | 118/2 |

FOREIGN PATENTS OR APPLICATIONS

| | | |
|---|---|---|
| 294,742 | 12/1971 | Austria |
| 1,284,702 | 8/1972 | United Kingdom |

*Primary Examiner*—Richard E. Aegerter
*Assistant Examiner*—L. Footland
*Attorney, Agent, or Firm*—H. William Petry; Luke J. Wilburn, Jr.

[57] ABSTRACT

Process and apparatus for the pattern dyeing of moving pile fabrics such as carpets, by the application of plural, continuously flowing dye streams, wherein the dyes are applied in multiple discrete small increments from the streams and control means are provided for accurately positioning the points of application of the dye increments in the pile fabrics to obtain sharp, detailed intricate patterns.

15 Claims, 6 Drawing Figures

DYEING AND PRINTING OF MATERIALS

This invention relates to the application of dyes or other liquids to textile materials and, more particularly, to the pattern dyeing of textile pile fabrics, such as carpets.

Textile fibers and fabric materials have long been colored with natural and synthetic dyes, and, in particular, printed by color decoration of the surface or surfaces of the materials in definite repeated forms and colors to form a pattern. Such color printing of textile fabrics has been accomplished in various ways. Earlier forms of printing used carved blocks charged colored paste pressed against the fabric. Subsequently, speed of printing was increased by development of roller printing wherein moving fabrics are sequentially contacted by engraved metal rollers each containing a different color dye to form the desired pattern thereon. Textile fabrics are also printed by sequential contact with screens having a porous portion of a pattern and carrying a particular color dyestuff.

More recently, it has been proposed to print textile fabrics, including pile carpets, by the programmed spraying or jetting of plural colored dyes onto the surface of the moving fabric. Typical of such processes and apparatus are described in U.S. Pat. Nos. 3,443,878; 3,570,275; and British Patent 978,452. Generally, such apparatus consists of a plurality of dye applicator bars or manifolds spaced along the direction of movement of the textile material and each containing multiple dye nozzles or jets extending transversely across the moving material. Each jet may be activated by suitable electric, pneumatic, or mechanical means to dispense dye onto the moving material, and pattern control to apply the dyes in a desired sequence may be accomplished by various conventional programming devices, such as mechanical cams and drums, coded punch tapes, magnetic tapes, computers, and the like.

U.S. Pat. Nos. 3,443,878 and 3,570,275 also disclose specific means for applying jets of dyes to print a fabric by use of continuously flowing dye streams which are deflected by a stream of air or a mechanical deflector to permit impingement of the dye stream upon the fabric or recirculation to a dye supply reservoir.

It can be appreciated that in the pattern dyeing of pile fabrics, such as carpets and the like, it is highly desirable to be able to achieve very detailed, sharp, and intricate patterns such as are obtained by conventional weaving processes employing multiple colors of yarns and control of the individual yarns to form the pattern, e.g., an Axminster or Wilton weaving process. Therefore, in the pattern dyeing of pile fabrics utilizing plural streams of dye which are selectively applied to the moving fabric to pattern the same, it is extremely important in such highly porous materials to accurately locate the dye in accurate amounts in the pile yarns of the fabric. For example, to achieve by pattern dyeing the definition which can be obtained by the aforementioned weaving processes, it is desirable that the dye applied be in small enough amounts as to dye a single yarn or tuft, or equivalent area, without undesirably wicking or migrating into adjacent tufts of the pile surface. Obviously then, accuracy of amount and placement of dye in the pile fabric becomes extremely important in dyeing pile fabrics intricate patterns.

It can be appreciated that certain factors can detrimentally influence accurate positioning of the dyes in the pile fabric. The speed of movement of the fabric must be carefully correlated to the application of the dyes. If the carpet speed varies with respect to the time of application of the dyes, inaccuracies in placement obviously occur. Similarly, if the flow rate of the dye varies with respect to the movement of the carpet to which it is applied, undesirable shading and inaccurate placement problems result. Thus, applying the exact amount of dye to the exact spot on the carpet, e.g., enough dye to dye the full length of a single tuft of yarn, is a much sought for goal in pattern dyeing of carpets.

It is therefore an object of the present invention to provide a process and apparatus for the accurate pattern dyeing of pile fabrics employing multistream jet dyeing equipment, which is an improvement over such as described in the aforementioned patents U.S. Pat. Nos. 3,570,275 and 3,443,878. As disclosed in these patents, continuously flowing streams of dye are directed toward a moving fabric and intermittently deflected from contact with the fabric in such a manner as to place a pattern on the fabric. If the speed of the fabric or the flow rate of the dye varies during the application of these streams, the pattern may exhibit undesirable varying results.

To minimize these problems, the present invention provides a process for dyeing wherein the amount of dye applied to the pile fabric can be accurately controlled by a unique application of the streams in repeating increments of dye, wherein all of the continuously flowing streams in a given gun bar are deflected simultaneously at repeating intervals of time throughout the dyeing operation to effectively apply the dye in discrete incremental spots, or "shots", to the pile fabric. In this manner, a given area of the fabric is dyed by repeated, intermittent applications of dye to the pile, instead of an uninterrupted continuous flowing stream of dye over the area. For example, if it is desired to apply a continuous solid line of dye along the length of the pile fabric beneath a particular dye stream, the stream does not strike the fabric continuously throughout the length of the line, but, instead, dye is applied in discrete increments by periodic deflections of the stream correlated to the movement of the fabric. This provides much more accurate control of the amounts of the dyes that can be placed on the fabric and also minimizes the chance of inaccurate positioning of the dye due to possible erratic carpet movement during the application of the dye to a desired area of the fabric.

As a further aid to placement of accurate amounts of dye on the pile fabric, the process and apparatus of the present invention provides means for applying the streams to the fabric for selectively variable time segments within the time intervals between simultaneous deflections of all streams, thus permitting the amount of dye applied from individual streams to be independently controllable to achieve intricate shading and/or "in situ" blending of dyes from different gun bars, if desired.

The present invention utilizes apparatus which comprises a jet pattern dyeing machine having a plurality of gun bars each containing plural dye jets extending across the width of an endless conveyor. The gun bars are spaced along the conveyor, and textile materials are carried by the conveyor past the gun bars where dyes are applied to form a pattern thereon. The application of dye from the individual dye jets in the gun bars is controlled by suitably adapted pattern control means of the type heretofore mentioned.

The present invention will be better understood by reference to the accompanying drawings which disclose a specific embodiment of the invention, and wherein.

Figure 1:
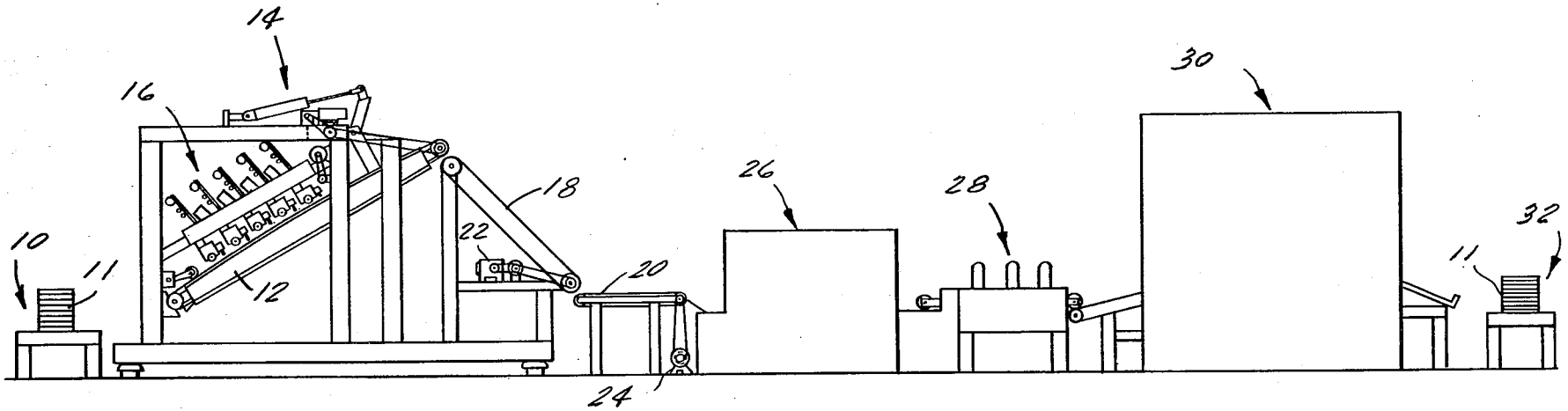
FIG. 1 is a schematic side elevation of apparatus for the jet dyeing and printing of textile materials.

Referring more specifically to the drawings, FIG. 1 shows a jet printing apparatus for pattern dyeing textile materials, such as pile carpets, carpet tiles, and the like. As seen, the apparatus consists of a supply table 10 from which a plurality of pile carpet tiles 11 to be dyed are laid manually, or by suitable mechanical means, not shown, onto the lower end of an inclined conveyor 12 of a jet applicator section 14, where the tiles are suitably printed by the programmed operation of a plurality of jet gun bars, generally indicated at 16, which inject streams of dye or other liquid, if desired, onto the pile surface of the tiles during their passage. The patterned tiles leaving the applicator section are moved by conveyors 18, 20 driven by motors 22, 24 to a steam chamber 26 where the tiles are subjected to a steam atmosphere to fix the dyes thereon. The dyed tiles leaving steam chamber 26 are conveyed through a water washer 28 to remove excess unfixed dye from the tiles, and then pass through a hot air dryer 30 to a collection table 32 where the dried tiles are accumulated manually, or by suitable means, not shown, for subsequent use. Obviously the conveying system could be employed to transport other materials such as continuous or broad loom pile carpets for dyeing with provision of conventional supply and delivery take-up.

Figure 2:
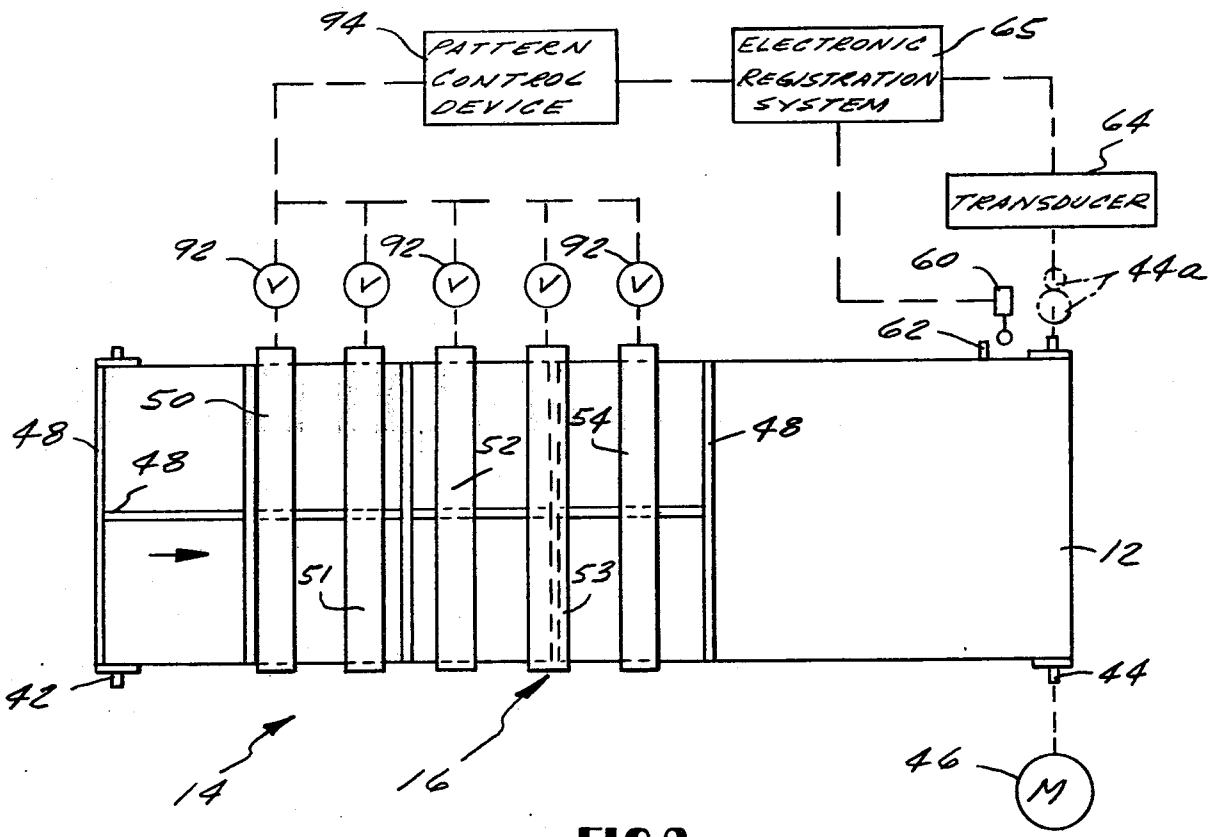
FIG. 2 is an enlarged schematic plan view of the jet dye applicator section of the apparatus of FIG. 1, showing in more detail the cooperative relation and operation of the conveyor with the jet gun bars.

Details of the apparatus of the present invention are further shown by reference to FIGS. 2–5. FIG. 2 is an enlarged schematic plan view of the jet applicator section 14 of FIG. 1 and shows the endless conveyor 12, the supporting chains and sprockets of which (not shown) are suitably supported for movement on rotatable shafts 42, 44 one of which, 44 is driven by motor means 46. For printing carpet tiles of rectangular or squareshape, the surface of conveyor 12 is provided with a series of separator bars or spacers 48 which accurately position the tiles in spaced relation to each other on the supporting slats of the conveyor. During movement of the conveyor, the tiles pass sequentially adjacent and beneath substantially identical gun bars 16, five of which, 50–54, are shown schematically, spaced along the path of travel of the conveyor and extending across its full width.

Figure 3:
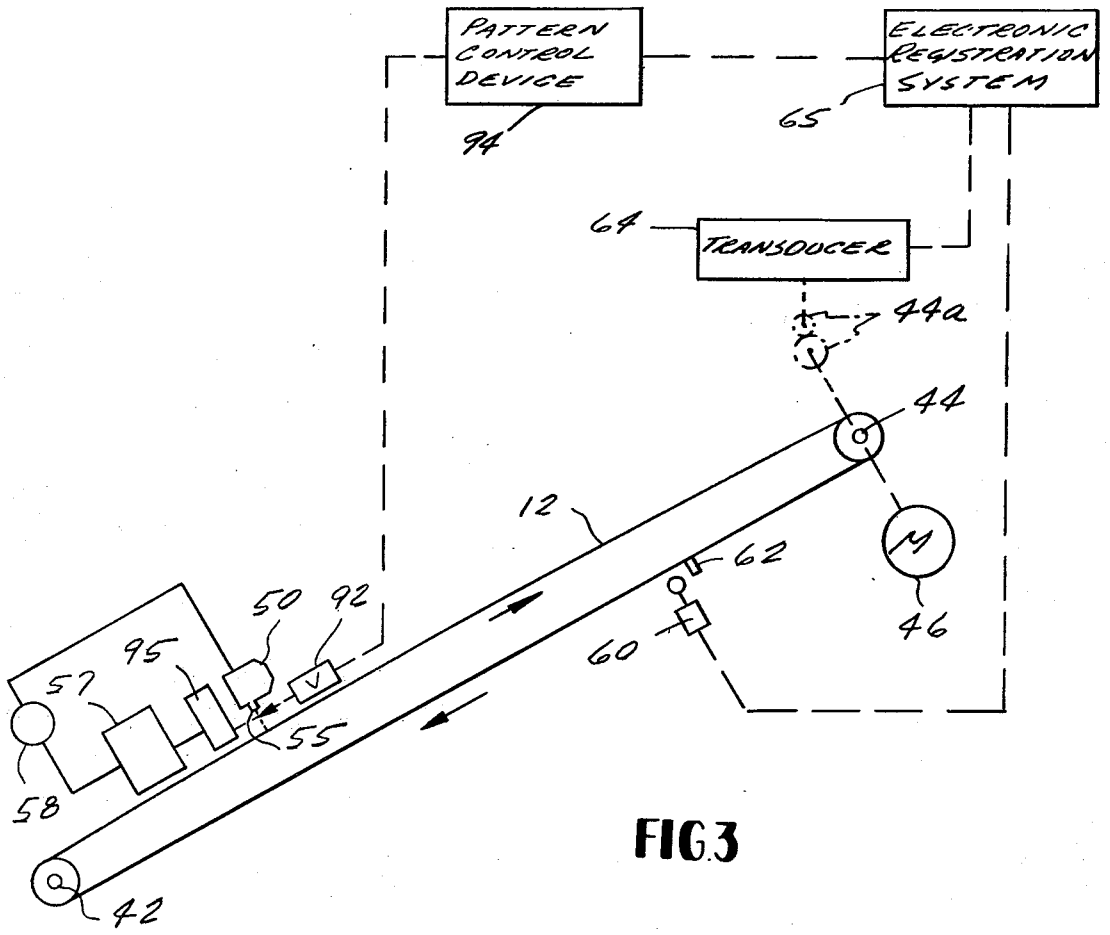
FIG. 3 is a schematic side elevation view of the jet dye applicator section seen in FIG. 2 and showing only a single jet gun bar of the applicator section and its operative connection to the dye supply system for the gun bar.
Figure 4:
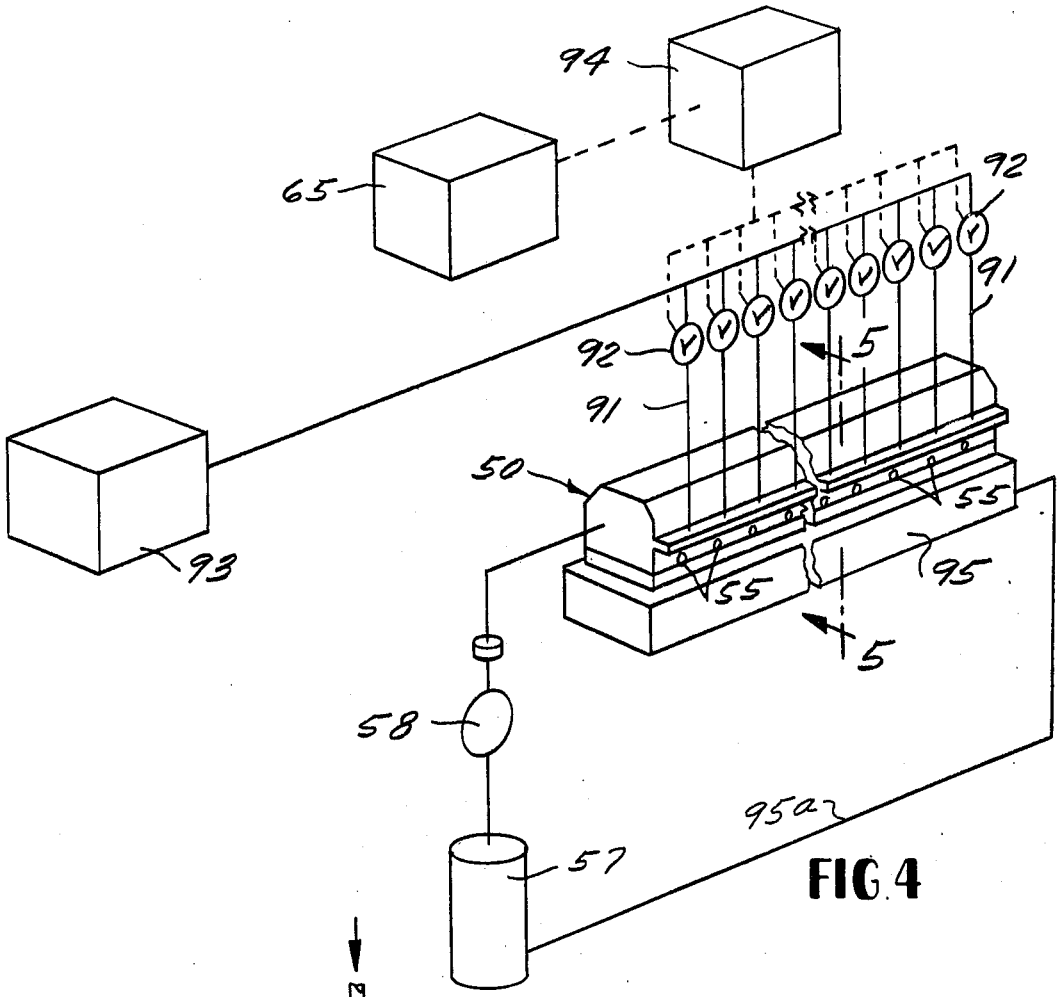
FIG. 4 is a more detailed perspective view of the jet gun bar seen in FIG. 3, and shows its operative connection to its dye supply system and the pattern control components of the apparatus.
Figure 5:
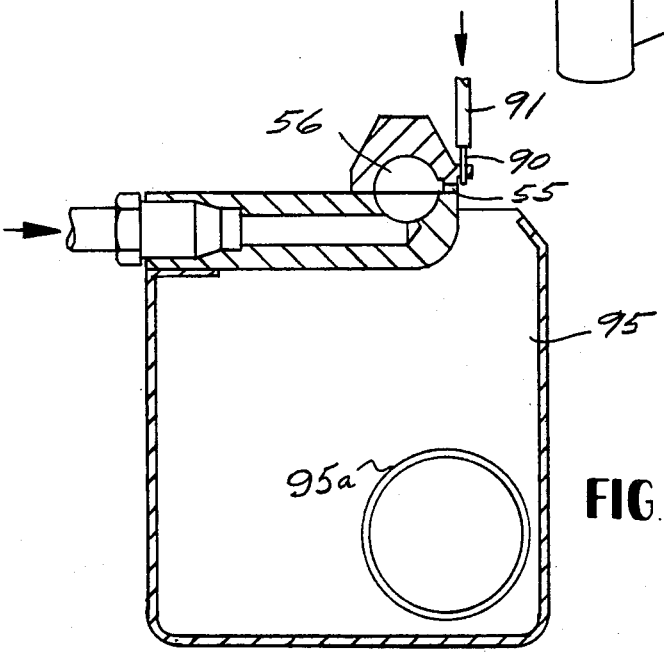
FIG. 5 is an enlarged schematic sectional view of the gun bar of FIG. 4, taken generally along line 5—5 thereof.

As best seen in FIGS. 3 and 4 which show only the single gun bar 50 for sake of clarity, each gun bar of substantially identical construction contains a plurality of individual jet orifices 55 disposed along the bar and positioned to direct dyes in narrow streams or jets of dye toward the surface of the pile carpet tiles as they pass thereby. Each gun bar includes a dye supply manifold 56 (FIG. 5) communicating with the jet orifices 55 which is supplied with liquid dye from a separate dye reservoir tank 57. Pump means 58 supplies liquid dye from reservoir tank 57 under pressure to manifold 56 and the jet orifices 55. During operation, liquid dye is expelled continuously in small streams or jets from the orifices 55 toward the material to be printed.

Positioned adjacent and at a right angle to the outlet of each jet orifice is an outlet 90 of an air supply tube 91 (FIG. 5), each of which communicates with a separate solenoid valve 92 (FIG. 4). The solenoid valves, which are of the electric to fluidic interface type, such as LIF 180D3A12 made by The Lee Company of Westbrook, Conn. are suitably supported in the jet dye applicator section 14 and are supplied with air from an air compressor 93. Although the valves for each gun bar are shown in FIGS. 2 and 3 as a single valve symbol 92, for clarity, it is to be understood that a solenoid valve and individual air supply tube is provided for each jet orifice of each gun bar such that individual streams of dyes can be individually controlled. The valves are controlled by a pattern control device or mechanism 94 to normally provide streams of air to impinge against the continuously-flowing dye streams and deflect the same into a catch basin or trough 95 from which the dye is recirculated through conduit **95*a* to the dye reservoir tank 57. The pattern control device 94 for operating the solenoid valves comprises, in the present embodiment, a digital switching device with magnetic tape transport for pattern information storage. Generally, for printing repeating patterns, the magnetic tape may be provided with a repeating sequence of information which is transmitted to the solenoid valves until a desired number of tiles have been printed. In the present case, a series of 10 tiles may be placed in spaced relation to each other on the conveyor belt and the pattern control device is initially activated as the leading edge of the first tile presents itself beneath the first gun bar 50**. Information from the magnetic tape and switching device is then fed to cut the solenoid valves off and on in accordance with the present invention to be explained and sequentially dye the tiles with the desired pattern as they pass beneath the sets of the gun bars.

In operation of the presently disclosed apparatus with the pattern control device 94 supplying no information to the valves of the gun bars, dye under pressure is continuously supplied in a stream from each jet orifice 55 toward the pile fabric to be printed. Every solenoid valve is normally open to supply streams of air to impinge against the continuously flowing dye streams and deflect them all simultaneously into the troughs of the gun bars for recirculation. As the first of the series of tiles to be printed passes beneath the first gun bar and the pattern control device is actuated, certain of the normally open solenoid air valves are closed so that the corresponding dye streams are not deflected but impinge directly upon the textile material. Thus, by cutting on and off the solenoid air valves in a desired sequence, a printed pattern of dye is placed on the textile material during its passage.

During continued use of the dyeing apparatus of the present invention, the speed of the conveyor transporting the textile materials may vary slightly or its position otherwise be altered which might cause the pattern of dye being placed on the tiles to become misaligned with the materials to be printed. Thus, means are provided in accordance with the present invention to correlate to the conveyor position the point of initiation of the signals from the pattern device 94 to the air valves. As broadly shown in FIGS. 2 and 3, the control system comprises a synchronization switch 60, a transducer 64, and an electronic registration system 65. Switch 60 is periodically engaged by a mechanical trip finger 62 attached to the edge of the conveyor 12, while transducer 64 is operatively connected to the shaft 44 to convert mechanical movement of conveyor 12 to an electrical signal.

As best shown in FIG. 2, transducer 64, which may be of mechanical, optical, or an electromagnetic type such as an Optitac SP 270 manufactured by Frontier Electronics, is mechanically connected to shaft 44 by gears 44*a* to emit a desired number of pulses per revolution of the shaft and per inch of travel of the conveyor. In the present example, transducer 64 is geared to emit 25 electrical pulses per inch of travel of the conveyor. Pulses from transducer 64 pass to the electronic registration system 65 which handles the pulse signals and forwards an activation or enabling pulse to the pattern control mechanism 94 to enable the mechanism to send the desired command signals to the individual valves of the gun bars. The registration system 65 is designed to permit minute manual adjustment of the timing of the transducer signals being sent to activate or enable the pattern control mechanism to transmit its air valve control signals to the gun bars. Details of such registration system are described and claimed in copending, commonly assigned U.S. patent application Ser. No. 430,526 filed Jan. 3, 1974, the disclosure of which is incorporated herein by reference.

Thus in operation, signals from transducer 64 pass, by way of electronic registration system 65 to the pattern control device 92 as the conveyor moves the pile fabric to be dyed past the gun bars. In this embodiment, the pattern control mechanism 94 is enabled to send signals to the air valves for a given cycle of operation only after receipt of this conveyor-originated signal. Therefore, it can be seen that the transmission of command signals to deflect the dye streams is correlated to the movement of the conveyor whereby the signals are sent to fire the individual streams of the gun bar at the pile material only after material has advanced a predetermined, preselected distance relative to the gun bar positions. Typically, if it is desired to pattern dye a tufted pile carpet having a tuft row spacing of 1/10 of an inch both in transverse and longitudinal direction, the spacing of the orifices of the gun bar might be 1/10 of an inch on centers, and the registration system signals to activate the pattern control device set to 10 enabling signals per inch of conveyor travel. In this way, it is insured that the pile carpet is advanced 1/10 of an inch in travel between each application of the dye by the gun bars, thus insuring that the individual shots of dye from each gun bar cover the area of one tuft or its approximate equivalent.

The pattern control device 94 of the present invention is designed and constructed to provide signals to each of the air valves of the system to selectively deflect or permit the dye streams to strike the moving pile carpet in accordance with the programmed pattern. Thus, until the air valves of the gun bars are actuated by receipt of a firing signal from the controllng device 94 the valves are supplying air to maintain all dye streams of the gun bars simultaneously deflected, with the intervals of time between signals from the control device 94 being determined by the movement of the conveyor.

Figure 6:
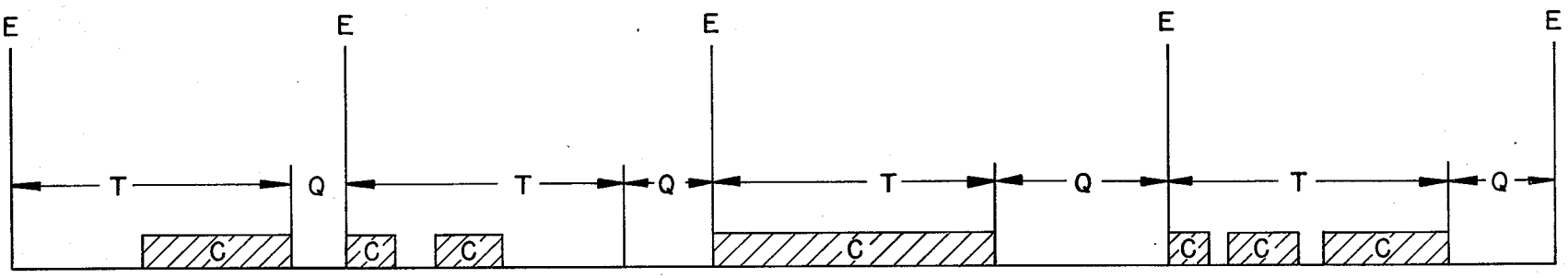
FIG. 6 is a diagrammatic representation of a time line illustrating a preferred sequence of firing of the dye streams into the pile material to be dyed, as programmed in accordance with the present invention.

During this time interval, the pattern control device has means for applying the dye streams to the pile fabric for selected time periods. As best shown by the time line in FIG. 6, after the pattern device has received an enabling signal E from the registration system 65, it is conditioned to send command signals to close selected air valves and apply dye from the corresponding dye streams into the pile carpet. The duration for which any one air valve may remain closed (thereby providing no deflecting air to the dye stream) may be varied within a time period by suitable means such as an analog or a digital timer.

The duration of the time period T in which selected ones of the valves may be actuated is fixed at the start of the operation and is uniform in each time interval, even though the time intervals may vary. In selecting a time period in which the pattern control device may send command signals to the valves of any one gun bar, the longest time period which may be selected is shorter than the shortest time interval which may be expected to occur by an amount which leaves a quiescent time during each interval, such time to allow for valve switching speeds, for electronic timing error, and for variations in the speed of the conveyor. In other words, referring to FIG. 6, the elapsed time between successive E's comprises the aforesaid time period T in which the pattern control device can send signals to the valves and a remaining quiescent time period Q for the purposes aforesaid.

For example, with the conveyor and pile fabric moving at a constant speed of 2 yards per minute enabling signals are sent to the pattern control device at 82 millisecond intervals. The fixed time period within this interval in which the dye may be applied to the pile surface is set at 25 milliseconds with actual times of application within this period being programmed in an ON-OFF cycle of operation. The time period T may be broken up into a number of time segments, e.g., 31, and each air valve may be signalled to remain closed for a selected number of such segments C which constitutes an ON time of operation. The remaining segments, in which the valve is open to deflect the dye stream, should constitute the OFF time of operation within the ON-OFF timer period T. This provision is of particular advantage when "in situ" blending of dyes from different gun bars is desired. Thus it can be seen that if two of the gun bars contain the primary colors of blue and yellow, various shades of green may be obtained by sequentially applying dye to the same spot on the carpet, an increment of dye from one gun bar supplying the blue dye stream and an increment of dye from another gun bar supplying the yellow dye stream.

If "in situ" blending is not to be employed in the dyeing operation, but dyeing is to be accomplished by applying desired dyes in selected areas from but one gun bar containing a desired color, the air valves selected to be actuated may remain closed for the entire time period T. The duration of the time period would be selected at the beginning of the dyeing operation on the basis of pile fabric characteristics, viscosity and flow rate of the dye streams, etc., to insure that the amount of dye applied to the fabric is sufficient to fully cover a desired tuft or tufts to their base without wicking or bleeding into the adjacent areas.

The hardware which may be employed in the pattern control device in the above described operations may be of various types known in the art. For example, the pattern control device may be composed of a PDP 11–40 computer supplied by Digital Equipment Corporation which includes a magnetic tape transport and a fixed head disc system. To provide the control data for the time segments which might be selected for the actuation of the valves, a plurality of analog timers may be employed. To direct the appropriate signals to the appropriate valves there can be employed electronic switch gear familiar to those skilled in the art.

Other specific hardware which may be employed as the pattern control device of the present invention, which hardware has a two-time segment dye application capability, is disclosed in copending, commonly assigned U.S. patent application Ser. No. 477,461, filed June 7, 1974 the disclosure of which is incorporated herein and a copy of which, including specification, claims, drawings, and declaration is attached and appears in this application immediately after the claims and before my declaration.

Obviously, the particular size and spacing of the dye orifices, the viscosity of the dyes employed, the amount of dyes applied to a particular target on the pile fabric, etc., will vary depending on the particular characteristics of the fabric to be dyed. Experience in the pattern dyeing of pile carpets indicates that for carpets having a range of density and pile heighths from 15 to 45 oz. per square yard and 0.125 in. to 1.5 in., respectively, dye jet spacing of 0.10 in. and orifice sizes of 0.010 to 0.025 in. (with a jet length to diameter ratio of 5 to 13) produces desirable results in the process. In addition, viscosity of dyes ranging from about 50 to 1000 cps. have been found highly effective in dyeing carpets. Typically, the pressure of the dye streams may vary from 8 to 15 psi.

Obviously the exact intervals of time between enabling signals E, periods of time T in which the signals may be sent from the pattern device to the valves, the quiescent periods of time Q in the cycle of operation will vary, depending upon many perimeters, e.g., carpet speed, density and type of pile yarns employed in the carpet, desired spacing of minimum dye increments applied to the pile, viscosity and pressure of application of the dyes, minimum valve switching speeds, etc. In practical experience with the hereindescribed dyeing apparatus being employed to pattern dye pile fabric moving at 10 yards per minute to apply a 300% pickup of liquid dye based on the weight of the pile yarns, and with a minimum spacing of dye increments of 1/10 inch along the fabric, the interval of time between enabling pulses E would be 16.5 milliseconds. The time period T during which the firing signals could be sent would be of 15 millisecond duration, leaving a quiescent period Q of 1.5 millisecond. This would provide a minimum quiescent time to allow for a valve switching time of 1.5 milliseconds (the switching speed of the hereinidentified air valves) if the valves are to be maintained in OFF position for the full ON-OFF cycle time period T. Preferably the time Q is at least about 5% of the interval between enabling pulse or signals.

As disclosed, the pile fabric is moved along an inclined path during the application of the dye streams thereto. The angle of inclination employed is selected to obtain a balance between the detrimental effects of gravity on the directionality of the dye stream and the running or spreading of the increment of dye after application to the pile surface, while maintaining sufficient space between gun bar and pile surface to permit gravity drain of the recirculating catch basin or trough and minimize possible drippings of dye from the gun bar onto the carpet. Angles of from 15° to 50° from the horizontal might be employed with an angle of about 25° being found particularly satisfactory.

The present invention may be employed to apply any desired pattern to a fabric and it is particularly suitable for applying intricate non-geometric type patterns, such as oriental or floral patterns, which require detailed colored areas of small, irregular dimensions.

Although the invention has been described in reference to the particularly difficult problems associated with the pattern dyeing of pile fabrics, and carpets in particular, it is to be understood that the process and apparatus of the present invention may be employed to satisfactorily pattern dye other porous textile materials, such as warp yarn sheets, woven, knitted, and non-woven fabrics, and the like.

The process of the present invention may be illustrated by the following specific examples:

EXAMPLE I 2.04 cotton count, 2 ply, 4.5 tpi S twist staple yarns of Antron nylon type 838 are suitably adhesively bonded to a scrim-reinforced non-woven backing sheet to form a cut pile bonded carpet having 13.5 yarn ends per inch laterally and 18 yarn ends per inch longitudinally. The carpet, having a pile yarn weight of 41 oz. per square yard and a 0.25 inch pile height is cut into 18 inch sq. tiles. The tiles are lightly brushed to stand the pile upright and placed on the conveyor of the hereindescribed jet dyeing machine. The conveyor has suitable guides to accurately position the tiles at spaced intervals 2 inches apart. A computer-generated pattern control tape is employed in the pattern control device to control application of dye liquor to the tiles to create an evenly spaced pattern of 36 1 inch squares on each tile.

The dye liquor employed comprises:

| COMPONENT | PARTS BY WEIGHT |
|---|---|
| Formic Acid (90%) | 2.5 |
| [1]Progalan PCN-2 | 0.6 |
| [2]Chemco Antifoam 73 Special | 1.0 |
| [3]Polygum CP | 0.7 |
| [4]Tectilon Blue 4G 200% | 0.1 |
| Water | 95.1 |
| | 100 |

[1]Blend of wetting agents and surfactants-Chemical Processing of Georgia.
[2]Blend of alcohols-Chemical Processing of Georgia.
[3]Modified natural gum thickener-Polymer Southern.
[4]Dyestuff-Acid Blue 40-Ciba Geigy.

The dye liquor has a pH of 2.3 and a viscosity of 54 centipoise as measured on a Brookfield Viscometer (Model LVF) using spindle No. 1 at 60 RPM.

The jet dye machine is set up to print 10 of the above described tiles spaced 2 inches apart in the machine direction on the conveyor on a dyeing cycle that is triggered by a signal from the conveyor-actuated micro-switch precisely positioned onto the conveyor. The pressure on the dye supply manifold is 13 psi and the pressure on the air supply manifold is 8 psi. The linear speed of the conveyor is 20 yards per minute. The air-deflected dye jets of nominal 14 mils diameter and 0.125 inch channel length are spaced along the gun bars on 0.1 inch centers in the lateral direction, i.e., perpendicular to the direction of carpet movement. Dye flow through a single jet orifice is 35 milliliters per minute measured as continuous flow. The pattern of squares mentioned is created by firing bursts of dye liquor of 24 millisecond duration at the desired areas of the tiles each time the conveyor (and therefore the tiles) advances 0.1 inch relative to the fixed position of the dye jets. The distance from dye jet orifice to the surface of the pile is approximately 1.5 inches.

The printed tiles are then steamed for 4 minutes on the continuous belt steamer under saturated steam conditions (212°F., 1 atm). At the exit of the steamer a series of water spray nozzles coat the back of the tiles and cold air is blown on the tile faces. The tiles then pass through the washer which sprays ambient temperature water on the face and vacuums it off, the objective being to remove residual thickener, chemicals, and any unfixed dyestuff. The tiles are then dried in a rotary drier at 275°F. Upon exiting from the dryer the tiles are placed on a flat, water-cooled table for five minutes before inspection and packaging.

EXAMPLE II 2.24 cotton count, 2 ply, 4 tpi S twist Anso (Allied Chemical) nylon spun yarns are tufted on a 5/32 inch gauge, 12 foot wide cut pile tufting machine into a Typar (DuPont polypropylene) non-woven backing. Pile height is 17/32 inch. After dyeing and finishing, including shearing, the pile height is ½ inch and the face fiber weight is 34.4 oz. per yard.

For purposes of preparing samples, the above described fabric is hand cut into 18 inch long, 9 inch wide pieces. The sample pieces are then pad dyed with a background shade by immersing the piece into a container of dye liquor (formulation given below) for 8 seconds and passing them through a conventional pad to squeeze the dye liquor pickup down to 100% based on the weight of the face yarns. The composition of this background color shade is:

| COMPONENT | PARTS BY WEIGHT |
|---|---|
| Polygum CP (Polymer Southern) | 0.9 |
| $NaH_2PO$ | 0.4 |
| $Na_2HPO_4$ | 0.1 |
| Merpacyl Yellow 4G (Powder) (DuPont) | 0.02108 |
| Merpacyl Red G (Powder) (DuPont) | 0.00420 |
| Merpacyl Blue 2GA (Powder) (DuPont) | 0.00700 |

-continued

| COMPONENT | PARTS BY WEIGHT |
|---|---|
| Water | 98.568 |

The pH of the final mix is 6.3 and the viscosity is 62 centipoise as measured on a Brookfield Viscometer Model LVF with spindle No. 1 at 60 RPM.

The padded samples are then placed on the conveyor of the jet dyeing machine and passed beneath two successive gun bars at 2.0 yards per minute. Two colors are applied from separate gun bars to the tufted carpet sample and the compositions of the two dye liquors are given below. Each gun bar had nominal 20 mil diameter dye jets of 0.125 inch channel length spaced on 0.1 inch centers. The distance between the gun bars is 12 inches. Pressure on both dye manifolds of the gun bars is 14 psi and pressure on both air manifolds is 10 psi. The dye flow rate for a single jet measured continuously is 120 milliliters per minute and the jet orifices are located approximately 1.5 inches from the pile surface.

DYE COMPOSITIONS

| COMPONENT | PARTS BY WEIGHT |
|---|---|
| Polygum CP (Chem. Process. of Ga.) | 1.0 |
| Formic Acid (90%) | 1.5 |
| Chemco Antifoam 73 Special (Chem. Process. of Ga.) | 1.0 |
| Progalan PCN-2 (Chem. Process. of Ga.) | 0.6 |
| Dyes from I or II, below | |
| Water | Remainder to Complete 100 parts |

pH = 2.5
Viscosity = 145 cps. (Brookfield Model LVF, spindle No. 1, 30 RPM)

DYES

| | Gun Bar I Parts by Weight | Gun Bar II Parts by Weight |
|---|---|---|
| Verona—Isalan Yellow NW (250%) | 0.10000 | 0.375 |
| Ciba Geigy—Tectilon Blue 46 (200%) | 0.00132 | 0.00496 |
| Allied Chem.—Alizerine Violet NRR | 0.00100 | 0.00392 |
| | 0.10232 | 0.38388 |

The jets are fired at desired areas of the fabric for 24 millisecond burst durations.

After pattern dyeing, the samples are steamed for 8 minutes at saturated steam conditions (212°F., 1 atm) and then washed with cold water, run through a nip roll, and dried at 250°F.

The dyed samples are backed with 32 oz. per square yard latex adhesive and 4.2 oz. per square yard SB-34 woven Polyback (PatchoguePlymouth Company) (100% polypropylene fiber). The samples are sheared with a sample shear machine.

That which is claimed is:

1. A method of dyeing a porous textile material, in particular pile fabrics and carpets, to obtain a desired pattern thereon with apparatus including conveying means for transporting the textile material past at least one row of jet orifices extending across the path of the textile material, deflecting means associated with said jet orifices, pattern control means to supply pattern data to control the operation of said deflecting means, and said pattern control means including timing means; said method comprising the steps of 1. transmitting pattern data from said pattern control means to said deflecting means in a multiplicity of repeating cycles (E-E) so that continuous dye streams from the jet orifices are directed onto or away from the textile material as required to form a single pattern, 2. initiating each of said cycles in response to movement of the textile material through a predetermined, preselected incremental distance,
3. directing one or more of the dye streams onto the textile material during one or more time controlled segments (C) of preselected duration within a fixed time period (T) in selected cycles in accordance with said pattern data and the operation of said timing means, and
4. maintaining within each cycle a quiescent time (Q) during which all of said dye streams in the row are directed away from the textile material.

2. A method as defined in claim 1 wherein the textile material is a length of tufted pile carpet material from which a multiplicity of area rugs may be cut, the specific pattern being an area rug pattern, and the entire pattern is applied to successive portions of the length of the tufted carpet material while it moves continuously past said orifices and thereafter through a succession of finishing processes.

3. A product produced by the method of claim 2.

4. A method as defined in claim 1 wherein an area of single color is dyed in a multiplicity of repeating cycles.

5. A method as defined in claim 1 wherein the direction of each dye stream onto the textile material is individually controlled.

6. A method as defined in claim 1 wherein the predetermined, preselected incremental movement of the textile material is uniform from cycle to cycle.

7. A method as defined in claim 1 wherein the length of the quiescent time provided in each cycle is at least equal to the recovery time of the deflecting means.

8. A method as defined in claim 1 wherein the textile material is a pile fabric and wherein the predetermined, preselected incremental movement of the textile material is approximately the distance between pile elements along the direction of movement.

9. A method as defined in claim 8 wherein said fixed time period in each cycle is selected to provide sufficient dye to said pile element of the fabric to dye substantially its full height.

10. A method as defined in claim 9 including the step of providing substantially the same number of dye streams in said row as the number of pile elements in the fabric disposed transversely to its direction of movement.

11. A product produced by the method of claim 9.

12. A multicolored pile fabric produced by the method of claim 11.

13. A method as defined in claim 9 wherein the material is dyed by application of a spaced plurality of rows of orifices, and the dye streams of each of said rows are controlled in the manner defined.

14. A method as defined in claim 13 wherein the fixed time period in which the dye streams are directed onto the textile material is of different duration from row to row.

15. A method as defined in claim 1 wherein the dye streams are continuously discharged from the orifices under pressure.

* * * * *

UNITED STATES PATENT OFFICE
CERTIFICATE OF CORRECTION

Patent No. 3,969,779 Dated July 20, 1976

Inventor(s) William H. Stewart, Jr.

It is certified that error appears in the above-identified patent and that said Letters Patent are hereby corrected as shown below:

Column 1, line 13, after the word "charged" insert --with--.
Column 1, line 20, after the word "screens" insert --each--.
Column 1, line 33, the word "dye" should read --dyes--.
Column 6, line 52, the word "timer" should read --time--.
Column 7, line 32, the word "heighths" should read --heights--.
Column 12, line 18, delete the number "9" and insert --1--.
Column 12, line 20, delete the number "11" and insert --10--.
Column 12, line 21, delete the number "9" and insert --1--.

Signed and Sealed this

Twenty-third Day of November 1976

[SEAL]

*Attest:*

RUTH C. MASON
*Attesting Officer*

C. MARSHALL DANN
*Commissioner of Patents and Trademarks*